US006063010A

United States Patent [19]

Howd et al.

[11] Patent Number: 6,063,010

[45] Date of Patent: May 16, 2000

[54] EXERCISE APPARATUS

[76] Inventors: Frank L. Howd, 37 Center Rd., Tolland, Conn. 06084; John J. Paholski, 10 Brooks La., Ivoryton, Conn. 06442

[21] Appl. No.: 09/146,211

[22] Filed: Sep. 2, 1998

[51] Int. Cl.[7] ..... A63B 23/08

[52] U.S. Cl. ..... 482/79; 482/44; 482/80; 482/121; 602/5; 602/6

[58] Field of Search ..... 482/14, 23, 44, 482/79, 80, 121, 91, 122; 602/5, 6, 27, 28, 29

[56] References Cited

U.S. PATENT DOCUMENTS

| | | | |
|---|---|---|---|
| 2,022,883 | 12/1935 | Gee | 602/5 |
| 3,295,847 | 1/1967 | Matt, Sr. | 482/80 |
| 3,421,760 | 1/1969 | Freeman, Jr. . | |
| 3,672,670 | 6/1972 | Burzenski | 272/57 |
| 4,310,155 | 1/1982 | White . | |
| 4,337,939 | 7/1982 | Hoyle et al. | 272/96 |
| 4,371,160 | 2/1983 | Shooltz . | |
| 4,371,161 | 2/1983 | Williams . | |
| 4,844,058 | 7/1989 | Vogelbach | 128/80 |
| 4,998,722 | 3/1991 | Scott . | |
| 5,100,129 | 3/1992 | Porter et al. . | |
| 5,178,596 | 1/1993 | McIntire | 482/80 |
| 5,186,698 | 2/1993 | Mason et al. . | |
| 5,215,508 | 6/1993 | Bastow . | |
| 5,282,483 | 2/1994 | Wang | 128/882 |
| 5,368,536 | 11/1994 | Stodgell . | |
| 5,413,543 | 5/1995 | Drago . | |
| 5,433,684 | 7/1995 | Carrillo . | |

OTHER PUBLICATIONS

Selected pages from Smith & Nephew, Inc., Rehabilitation Division Catalog for 1998.

Selected pages from AliMed, Orthopedic Rehabilitation Catalog for 1996–1997.

Selected pages from Sammons Preston, Inc. Catalog for 1996.

Selected pages from FlagHouse Catalog for Spring 1998.

Selected pages from M A Rallis Corp. Catalog for 1997.

*Primary Examiner*—Richard J. Apley
*Assistant Examiner*—Tam Nguyen
*Attorney, Agent, or Firm*—Alix, Yale & Ristas, LLP

[57] ABSTRACT

A portable exerciser has a generally planar base for receiving a user's foot to be exercised and at least one resilient fastening member for flexibly fastening the user's foot to the base. The attachment member comprises a bar for attaching the resilient fastening member to at least one location on the base. When the resilient fastening member is attached to the base, it provides resistive force in opposition to movement of the user's foot and permits all of dorsiflexion, inversion and eversion exercise. The exercise apparatus can also include a force-bearing portion of the base so that a user can steady the base against movement with a non-exercising foot.

20 Claims, 3 Drawing Sheets

EXERCISE APPARATUS

BACKGROUND OF THE INVENTION

1. Field of the Invention

The present invention generally relates to the field of therapeutic exercise and muscle rehabilitation in humans. More particularly, the present invention is directed to methods and apparatus for facilitating exercise and rehabilitation of the lower leg muscles in the vicinity of the ankle. Accordingly, the general objects of the present invention are to provide novel and improved methods and apparatus of such character.

2. Description of the Related Art

The human ankle joint is capable of a wide range of motion. Such motion includes dorsiflexion (moving the foot upwardly), inversion (moving the foot toward the midline of the body) and eversion (moving the foot away from the midline of the body). Because the ankle joint supports the entire weight of the body during upright movement, it is, at times, subjected to severe stresses which can cause injury; this can occur while working, while performing day-to-day activities and especially during athletic activity. Due to such circumstances, ankle joint injuries are among the most common injuries suffered.

Moreover, the ankle joint plays an important role in maintaining balance. As individuals age and/or deteriorate due to disease, the ankle joint is commonly affected. This, in turn, compromises the individual's ability to balance and places the individual at serious risk of suffering a harmful fall.

Medical treatment of an injury to the ankle joint (such as a sprain, strain or break) commonly entails immobilization of the soft tissues which encompass the joint. In fact, the muscles, ligaments, tendons and nerves of the joint are often immobilized for a sufficient period of time thereby causing them to become weakened or atrophied. Thus, after the swelling associated with the injury has diminished, it is important to rehabilitate the ankle to restore stability, to restore range of movement, to increase strength and to recover neurological capabilities necessary to normal functioning. One way this is accomplished is by exercising the muscles surrounding the ankle, lower leg and foot through a desired range of motion on a device which is capable of providing resistance to such movement. Moreover, by strengthening the muscles in the lower leg and foot, one can significantly reduce the possibility of future ankle sprains and/or fractures. Additionally, by improving strength and range of motion, balance can be improved.

There has long been a need in the art for an inexpensive and compact exercise apparatus for strengthening the muscles of the ankle, lower leg and foot. Previously known devices designed for lower leg rehabilitation and exercise may be categorized based on the different tensioning structures used to oppose movement. Some devices provide movement in only one direction or in a very limited number of directions. Such devices do not offer, for example, all of dorsiflexion, inversion and eversion exercise throughout the full range of motion. Other devices lack variable tensioning capability throughout the full range of motion. Yet other devices are difficult to adjust the direction of the resistive force and/or the level of resistance while the device is attached to the user. Also, many devices utilize weight plates or cylinders which only provide concentric resistance and not isometric or eccentric muscle contraction resistance. In addition, many devices are too bulky and mechanically complicated to offer easy user portability or are not adjustably sizable to accommodate a wide range of foot and ankle sizes. This is, in large part, due to the use of substantial and expensive movement resistant structures of the type that may be found in a gymnasium.

The above-noted deficiencies of the related art, collectively, evince, inter alia, a need in the art for an exercise apparatus which will increase safety in the home and which is easier to use. These deficiencies also evince a need for an exercise apparatus which can reduce costs in clinics by reducing the demand for highly skilled physical therapists.

Accordingly, there is a need in the art for a simple, portable and inexpensive lower leg exercise apparatus which permits exercise throughout the full range of motion or all of dorsiflexion, inversion and eversion and which reduces costs and increases safety.

SUMMARY OF THE INVENTION

It is, therefore, an object of the present invention to provide an improved exercise apparatus which is simple, economical and portable and permits exercise throughout the full range of motion for all of dorsiflexion, inversion and eversion.

It is another object of the present invention to facilitate progressive rehabilitation through a gradual strengthening program, by the use of progressively stronger movement resisting members to oppose the movement of a user's foot.

It is yet another object of the present invention to provide a lower leg, ankle and foot muscle exercise apparatus which offers an optimal combination of simplicity, reliability, efficiency and versatility.

These and other objects and advantages of the present invention are provided in one embodiment by providing a portable exercise apparatus having a generally planar base for receiving a user's foot to be exercised and at least one resilient fastening member for resiliently fastening the user's foot to the base. The base includes means for attaching the resilient fastening member to at least one location on the base. When the resilient fastening member is attached to the base, it provides variable and isotonic resistive force in opposition to movement of the user's foot.

In its preferred form, the present invention is both lightweight and portable and can be used for preventive medicine as well as rehabilitation. Therefore, the inventive exercise apparatus can be easily used in a wide range of settings such as in a clinic, in a home or in a gym.

In one preferred embodiment of the base, the means for attaching or anchoring comprises an aperture extending through the base and at least one bar which divides the aperture into multiple sections. This permits looping of the resilient fastening member through the aperture, around the bar and around the user's foot. In another variation of this embodiment of the base, the means for attaching includes an aperture and three bars which divide the aperture into multiple sections. These three bars provide ideal locations to attach the fastening member for each of dorsiflexion, inversion and eversion exercise. In another preferred embodiment of the base, the means for attaching includes three distinct apertures, each of these apertures having a bar to affix the fastening member.

The exercising apparatus of the present invention can also include a force-bearing portion of the base so that a user can steady the base against movement with a non-exercising foot. It is also possible to form the base of the invention such that it presents two opposite and generally planar surfaces, each of which is designed to permit individual exercise of one of the user's feet. In this way, one simple device can be utilized to provide optimal exercise for both of the user's right and left feet. Finally, the base can optionally include a shallow recessed region which helps locate and maintain a user's foot in one place.

A wide variety of resilient fastening members, including elastic bands or cords of the type commonly used in the field of physical therapy, can be used with the present invention.

Numerous other advantages and features of the present invention will become apparent to those of ordinary skill in the art from the following detailed description of the invention, from the claims and from the accompanying drawings.

BRIEF DESCRIPTION OF THE DRAWINGS

The preferred embodiments of the present invention will be described below with reference to the accompanying drawings wherein like numerals represent like structures and wherein.

DESCRIPTION OF THE PREFERRED EMBODIMENTS

Figure 1A:
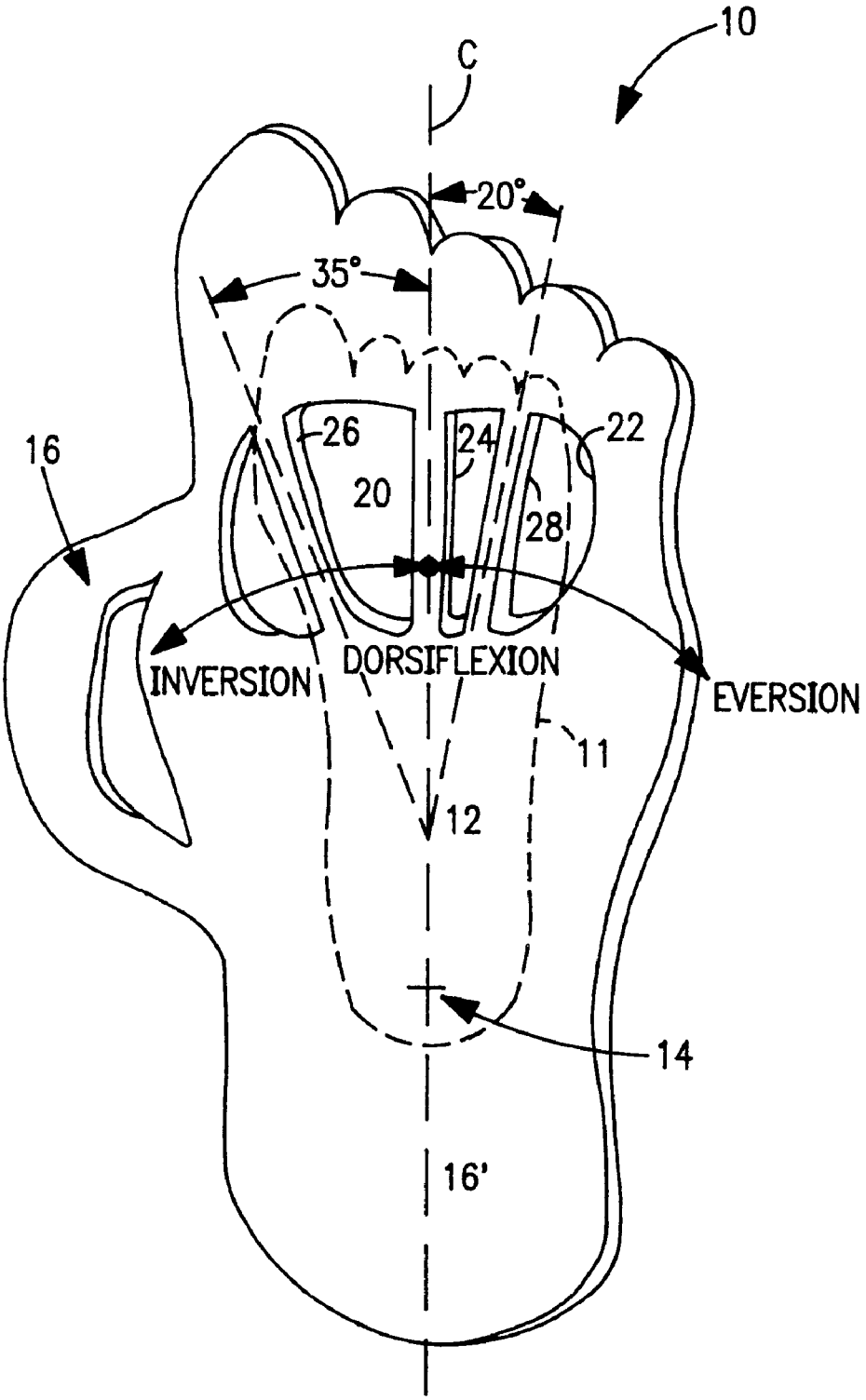
FIG. 1*a* is a perspective view of the base in accordance with the present invention.

The preferred embodiments of the present invention will now be described with joint reference to FIGS. 1 through 2*b*. As shown in FIG. 1*a,* a first preferred embodiment of the base of the present invention includes a generally planar, foot-shaped base 10 having a foot-receiving portion in the general vicinity of reference numeral 12 for receiving a user's exercising foot 11. Foot-receiving portion 12 includes a heel-receiving portion 14 and a ball-receiving portion in the general vicinity of reference numeral 20. As shown, ball-receiving portion 20 preferably includes a single enlarged aperture 22 with elongated first, second and third bar members 24, 26 and 28, respectively, which divide aperture 22 into four distinct sections. It should be noted that elongation of bar numbers 24, 26 and 28 is a highly significant feature in that elongation of these members permits the inventive exercise apparatus to accommodate virtually any foot size.

Base 10 generally defines a centerline C which longitudinally extends through the middle of base 10. Whereas first bar member 24 is substantially coaxial with centerline C, second and third bar members 26 and 28 are coplanar, but not coaxial, with centerline C. In particular, it is noted that second bar member 26 is preferably oriented substantially 35 degrees to the left of centerline C (in the FIG. 1*a* view). Similarly, third bar member 28 preferably extends in a direction which is substantially 20 degrees rightwardly of centerline C (in the FIG. 1*a* view).

In use, first bar member 24 is the preferred attachment location for a resilient fastening member (see FIGS. 2*a* and 2*b*) when the exercise apparatus of the present invention is utilized for dorsiflexion. Similarly, second bar member 26 is the preferred attachment location for the resilient fastening member during inversion. Finally, third bar member 28 is the preferred attachment location for the resilient fastening member during eversion. These three attachment locations are the optimal locations because they permit exercise throughout the full range of motion for all of dorsiflexion, inversion and eversion and thereby maximize training effectiveness. Moreover, the exercise is allowed to be completed isotonically throughout either partial or the full range of motion.

Still referring primarily to FIG. 1*a*, base 10 also preferably includes two force-bearing portions 16 or 16' upon which a user may place his non-exercising foot in order to steady base 10 against movement during exercise. While portion 16 extends from one lateral side of base 10, portion 16 constitutes an "enlarged heel region" of the base. It will be appreciated that force-bearing portion 16 also serves as a handle during transportation of the inventive exercise apparatus.

Figure 1B:
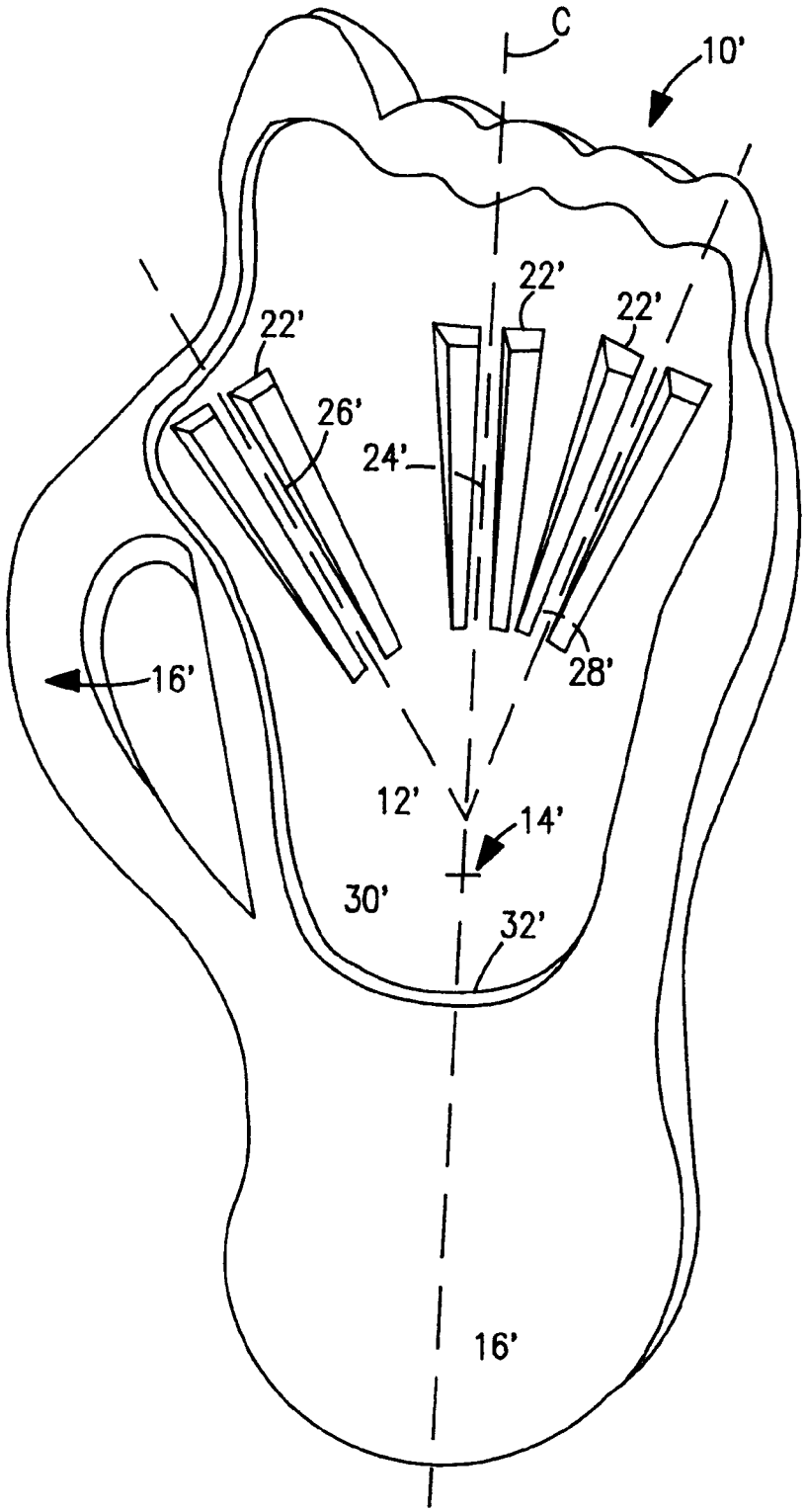
FIG. 1*b* is a perspective view of another embodiment of the base in accordance with the present invention.

A second preferred embodiment of the base of the inventive exerciser is shown at 10' in FIG. 1*b*. The primary differences between base 10 of FIG. 1*a* and base 10' of FIG. 1*b* resides (1) in the means for attaching the fastening member thereto; and (2) in the inclusion in the base of FIG. 1*b* of a shallow recessed region 30'. In particular, the embodiment of FIG. 1*b* utilizes three distinct apertures 22', each having one of bars 24', 26' or 28', in place of the single aperture 22 with bars 24, 26 and 28 of the FIG. 1*a* embodiment. This arrangement is both particularly strong and pleasing to the eye. The optional recessed region 30' of the FIG. 1*b* embodiment is between about ¼ to ⅜ of an inch in depth and increases proprioceptive awareness by maintaining a user's foot in one location. In particular, foot position is maintained because the user's heel abuts against lip 32' at region 14'. Naturally, recessed region 30' can be added to the base of FIG. 1*a* to increase training effectiveness of that embodiment as well. Aside from the above-noted differences, bases 10 and 10' are substantially identical to one another.

Figure 2A:
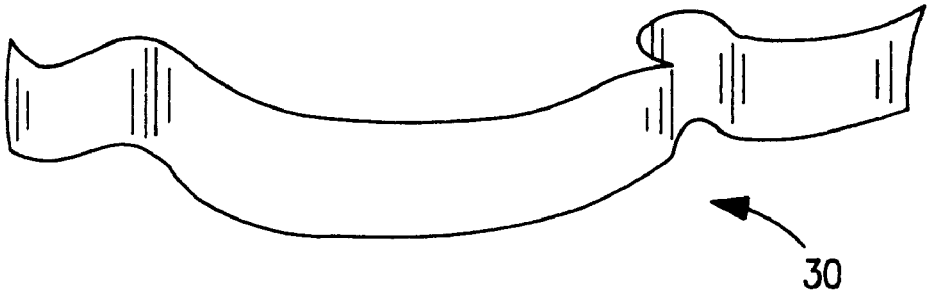
FIGS. 2*a* and 2*b* are two versions of the resilient fastening member in accordance with the present invention.
Figure 2B:
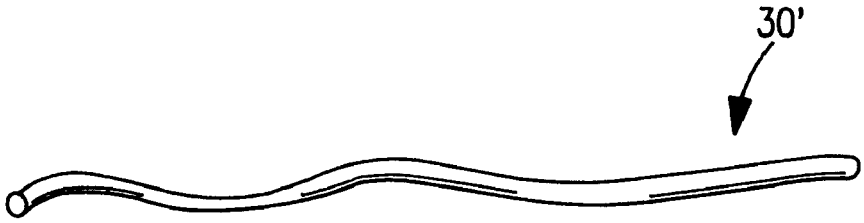

With reference now to FIGS. 2*a* and 2*b*, there are depicted two alternative resilient fastening members 30 and 30', respectively. Those of ordinary skill will readily appreciate that member 30 is an elastic physical therapy band of the type marketed under the THERA-BAND brand name. This band is approximately 1/32 inch thick, 5½ inches wide and 30 inches long. Those of ordinary skill will also appreciate that member 30' is a conventional elastic cord of the type marketed under the THERA-BAND brand name. This cord is preferably about ¼ of an inch in diameter and 30 inches long. Naturally, the many resistive strengths of these cords and bands which are available are compatible with the present invention to enable the exerciser to engage in a gradual strengthening program. For example, the resistive force supplied by the exercise apparatus can be varied by selecting bands or cords of various thicknesses and/or by looping the bands or cords any number of times desired.

When the inventive exercise apparatus is in use, at least one resilient fastening member is looped through base aperture 22 around the appropriate bar member 24, 26 or 28 and fastened around a user's exercising foot, the foot being placed onto base 10 in the manner suggested by the shape of base 10. In this location, the ball of the user's foot is conveniently disposed over aperture 22 so that the resilient fastening member can be tied across the top of the user's foot. With base 10 oriented in the manner shown in FIG. 1, the user's right foot would be the exercising foot and the user's left foot could be placed on one of force-bearing portions 16 or 16' in order to steady base 10 during eversion and/or inversion exercise. The inventive exercise apparatus can also be used to exercise a user's left foot by flipping base 10 over and feeding the resilient fastening means through the opposite side of base 10. In this way, the user's left foot is located on the foot-receiving portion of base 10 and the user's right foot can be placed on one of the force-bearing portions of base 10.

It should be appreciated that the two opposite and generally planar surfaces of base 10 are preferably mirror-images of one another. Accordingly, orienting base 10 to exercise either the user's left or right foot is simple and the user can achieve the full range of motion for all of dorsiflexion inversion and eversion regardless of which foot is being exercised.

Base 10 is preferably integrally formed from one of a wide variety of rigid and light-weight materials known in the art such as wood, plastic, epoxy resin, fiber glass, etc. The overall dimensions of base 10 are approximately 22 inches in the elongated direction and approximately 12 inches at the widest point thereof. Heel-receiving portion 14 is ideally located approximately 8.5 inches from the bottom portion of base 10.

While the present invention has been described in connection with what is presently considered to be the most practical and preferred embodiments, it is to be understood that the invention is not limited to the disclosed embodiments, but is intended to cover various modifications and equivalent arrangements included within the spirit and scope of the appended claims.

What is claimed is:

1. A portable exercise apparatus for exercising the muscles of a user's lower leg, ankle and/or foot, said apparatus comprising:

a generally planar and rigid base for receiving a user's foot to be exercised, said base having opposite laterally spaced sides and defining a centerline between said sides and including means for anchoring a resilient fastening member to at least one location on said base, said means for anchoring having non-parallel first, second and third bars, said bars being spaced from said sides, said first bar being coaxial with said centerline, and said second and third bars being disposed on opposite sides of said centerline; and at least one resilient fastening member for flexibly fastening the user's foot to the base to thereby provide resistive force in opposition to the exercising movement of the user's exercising foot.

2. The apparatus of claim 1, wherein said means for anchoring a resilient fastening member comprises a plurality of elongated apertures extending through said base and arranged such that said apertures define said first, second and third bars between adjacent pairs of apertures.

3. The apparatus of claim 1, wherein said second bar is oriented substantially 20 degrees to one side of said centerline for use during eversion exercise, and wherein said third bar is oriented substantially 35 degrees to the other side of said centerline for use during inversion exercise.

4. The exercising apparatus of claim 1, wherein said base further comprises a force-bearing portion for receiving the weight of the user's non-exercising foot whereby said base is steadied against any undesired movement, said force-bearing portion including a handle extending laterally outward from one lateral side of said base.

5. The exercising apparatus of claim 1, wherein said base is a double-sided base with two opposite and generally planar surfaces, each of said planar surfaces has a foot-receiving portion, and said means for anchoring can be accessed from either side of said base whereby both of the user's feet can be individually exercised.

6. The exercise apparatus of claim 1, wherein said base has a perimeter which is shaped like a human foot.

7. The exercise apparatus of claim 1, wherein said resilient fastening member consists of an elastic physical therapy band.

8. The exercise apparatus of claim 1, wherein said resilient fastening member consists of an elastic physical therapy cord.

9. A lower leg muscle exercising apparatus adapted to permit all of dorsiflexion, inversion and eversion exercise, said apparatus comprising:

a generally planar and rigid base having a foot-shaped perimeter and a foot-receiving portion with a heel-receiving portion and a ball-receiving portion spaced inwardly from said perimeter, said ball-receiving portion including means for removably attaching at least one resilient fastening member in one of a plurality of distinct locations to accommodate each of dorsiflexion, inversion and eversion exercise; and at least one resilient fastening member removably affixed to said base by said means for removably attaching, said fastening member flexibly fastening a user's exercising foot to the base to thereby provide resistive force in opposition to the exercising movement of the user's exercising foot.

10. The exercising apparatus of claim 9, wherein said base further comprises a force-bearing portion for receiving the user's non-exercising foot whereby said base is steadied against any undesired movement, said force-bearing portion including a handle extending from one lateral side of said base.

11. The exercising apparatus of claim 9, wherein said base is a double-sided base with two opposite and generally planar surfaces, each of said planar surfaces has a recessed foot-receiving portion, and said means for removably attaching at least one resilient fastening member can be accessed from either side of said base whereby both of the user's feet can be individually exercised.

12. The exercise apparatus of claim 9, wherein said means for removably attaching at least one resilient fastening member comprises means defining a plurality of elongated aperture pairs extending through said ball-receiving portion of said base.

13. The exercise apparatus of claim 12, wherein said base defines a centerline extending along the elongated direction of said foot-shaped base, and said means for removably attaching at least one resilient fastening member consists of nonparallel and elongated first, second and third bars, said first bar being co-axial with said centerline and said second and third bars being disposed on opposite sides of said centerline.

14. The exercise apparatus of claim 11, wherein said means for removably attaching at least one resilient fastening member consists of means defining an aperture through said base and at least one elongated bar dividing said aperture into multiple sections.

15. The exercise apparatus of claim 14, wherein said base defines a centerline extending through said aperture, said means for attaching at least one resilient fastening member includes non-parallel first, second and third fastening members, said first fastening member is co-axial with said centerline, and said second and third fastening members are disposed on opposite sides of said centerline.

16. The exercise apparatus of claim 9, wherein said base defines a centerline, and said means for attaching at least one resilient fastening member comprises an aperture extending through said base and at least three bars dividing said aperture into several sections, one of said bars being substantially coaxial with said centerline for use during dorsiflexion exercise, another of said bars being oriented substantially 20 degrees to one side of said centerline for use during eversion exercise and another of said bars being oriented substantially 35 degrees to the other side of said centerline for use during inversion exercise.

17. A portable exercising apparatus comprising:

a generally planar base for receiving a user's foot to be exercised, said base having laterally spaced sides and defining a centerline between said sides and including a heel-receiving portion and a ball-receiving portion spaced from said sides with at least one aperture and first, second and third non-parallel bars extending therethrough to permit the removable attachment of at least one resilient member to said base, said first bar being coaxial with said centerline, said second and third bars being disposed on opposite sides of and between about 20 and 35 degrees with respect to said centerline; and at least one removable resilient member extending through said at least one aperture and over the user's exercising foot when said member is attached to said base, said member providing resistance to the exercising movement of the user's exercising foot.

18. The exercising apparatus of claim 17, wherein said base is generally foot-shaped and further comprises a force-bearing handle for receiving the weight of the user's non-exercising foot whereby said base is steadied against the exercising movement and for grasping said base during transport of said apparatus, said handle defining a handle aperture and extending from one lateral side of said base.

19. The exercising apparatus of claim 17, wherein said base is a double-sided base with two opposite and generally planar surfaces, each of said planar surfaces has a foot-receiving portion, and said means for attaching can be accessed from either side of said base whereby both of the user's feet can be individually exercised.

20. The exercising apparatus of claim 17, wherein said foot receiving portion comprises a shallow recessed region having a lip against which a user's heel may abut.

* * * * *